US005291707A

United States Patent [19]

McDonald

[11] Patent Number: 5,291,707

[45] Date of Patent: Mar. 8, 1994

[54] BIRD PROTECTOR FOR EXHAUST STACK

[76] Inventor: Dixie N. McDonald, 210 N. James, Carlsbad, N. Mex. 88220

[21] Appl. No.: 858,728

[22] Filed: Mar. 27, 1992

[51] Int. Cl.[5] ..... E04H 12/28

[52] U.S. Cl. ..... 52/244; 52/101; 454/3

[58] Field of Search ..... 52/244, 101; 454/3, 454/36, 39

[56] References Cited

U.S. PATENT DOCUMENTS 2,526,079 10/1950 McCahan ..... 454/36

*Primary Examiner*—Carl D. Friedman
*Assistant Examiner*—Christopher T. Kent
*Attorney, Agent, or Firm*—Marcus L. Bates

[57] ABSTRACT

Bird protector apparatus for attachment to the outlet end of a flue gas stack that emits flue gases into the atmosphere. The stack has a concentrically arranged outer annular member spaced from the inner stack for flow of gas therebetween. The protector apparatus prevents birds from alighting on the end of the stack as well as on the protector itself. The protector apparatus comprises a conical wire mesh screen of a size to preclude birds traveling therethrough and to freely allow flue gases to flow therethrough, and has a lower end opposed to an apex. A clamp attaches the lower end of the wire cone to the upper end of the stack, with the apex being axially aligned with the centerline of the stack. An apparatus can be included on the exterior of the wire cone to frighten birds from perching on the apex.

17 Claims, 2 Drawing Sheets

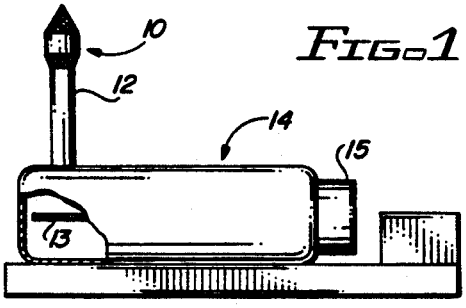
FIG. 1
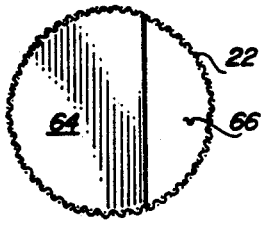
FIG. 6
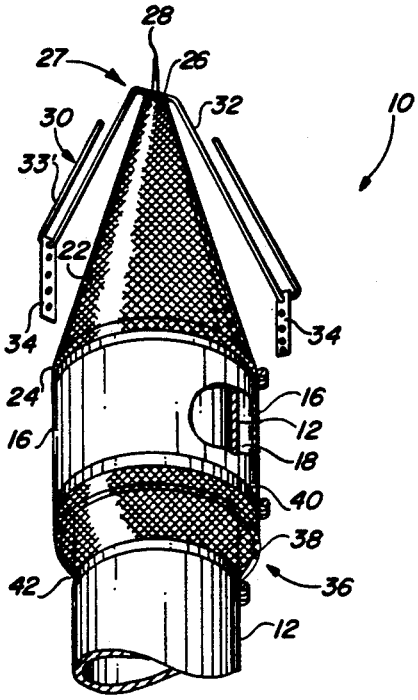
FIG. 2
FIG. 3
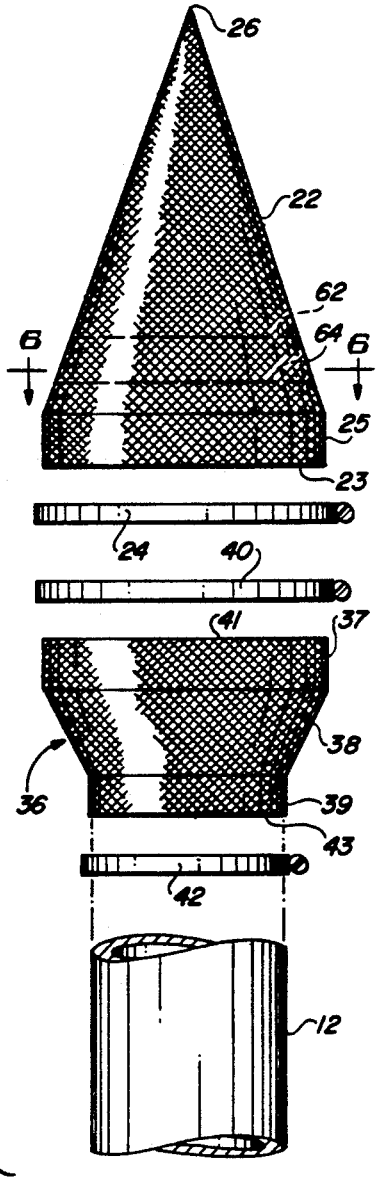
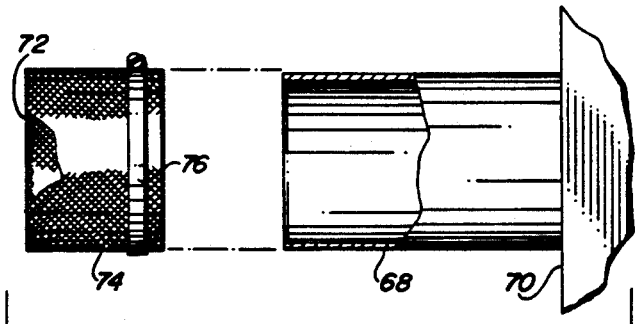
FIG. 7

BIRD PROTECTOR FOR EXHAUST STACK

BACKGROUND OF THE INVENTION

In the production of crude oil, it is often necessary to use dehydrators to remove water from the crude oil prior to transporting the crude to the refinery. The dehydrators are fire-tube heaters for heating the oil to effect separation between the oil and any water and debris contained therewithin. The stacks are usually a steel pipe 6 inches to 12 inches in diameter that normally extend vertically upward. The dehydrators operate intermittently and often are automatically and remotely controlled.

During the time the combustion burners are not burning, birds, bats, and other flying animals can enter the dehydrators through the stack where they build nests and when the combustion burners ignite, the flue gases rising through the stack kills the animals. This is a serious environmental problem because many of the birds and bats are protected species and therefore the environmental authorities require something to be done to prevent the birds from being killed. It is also a problem for the oil companies because workmen must clean the dead birds, nests, and associate material from the dehydrators.

This invention provides an effective and inexpensive solution to this environmental problem by securing an apertured barrier over the dehydrator stack outlet that precludes entrance of the animals thereinto and offers negligible resistance to the emission of the flue gases therefrom. Barriers of the prior art fail to address the problem of a bird perched on top of the stack. The gas can escape up the stack without being ignited. The hydrocarbon gaseous product used to fire most of these furnaces is, of course, noxious to the birds and bats. It is also necessary to provide a guard around the air intake adjacent to the burner. In fact, all openings into the heater combustion chamber must have a barrier provided to keep the animals out of harms way.

This invention is applicable to all dehydrator vessels having a vent stack. This invention also can be used in conjunction with the vent extending from oil storage tanks, because in many cases, dead birds are found within empty oil storage tanks.

SUMMARY OF THE INVENTION

This invention relates to a bird guard or protector apparatus for preventing birds and other flying animals from entering a flue gas stack that emits flue gases into the atmosphere.

More specifically this invention comprehends a bird protector for preventing birds and other flying animals from entering a flue gas stack of the type having an outer annular member spaced from the stack and concentrically arranged therewith for flow of gas therebetween. The bird protector in combination with the stack provides apparatus to prevent birds from alighting on the stacks as well as entering the annulus.

The bird protector apparatus preferably is a conical shaped screen of unitary construction, preferably made of wire mesh of a size to preclude birds traveling therethrough but freely allows flue gases to flow therethrough. The protector apparatus has a lower maginal end opposed to an apex thereof; and, a fastener means by which the lower marginal end is affixed to the upper marginal end of the stack, with the apex of the bird protector being axially aligned with the longitudinal axis of the stack.

In one embodiment of the invention, means are provided on the exterior of the apparatus to frighten birds from perching on the apparatus. The apparatus preferably terminates in a sharp member attached to the apex and extending upwards therefrom. The slope of the cone wall is about 70 degrees.

In another form of the invention, a perforated barrier, in the form of a frustrum of a cone, terminates in a large upper edge and a small lower edge and receives mounting members for attachment to the stack at the lower small diameter end and the upper large diameter end attaches to the outer shell.

Accordingly, a primary object of the present invention is the provision of a bird protector or guard for preventing birds and other flying animals from entering a flue gas stack that emits flue gases into the atmosphere.

Another object of this invention is to provide a bird guard that is attached to the outlet end of a flue gas stack of the type having an outer annular member spaced from the stack and concentrically arranged therewith for flow of air therebetween. The bird guard, in combination with the stack, provides an apparatus to prevent birds from alighting on the stack as well as preventing the birds from entering the annulus.

A further object of this invention is to disclose and provide a bird protector for isolating the outlet end of a flue gas stack from flying animals, comprising a conical screen made of wire mesh of a size to preclude birds from traveling therethrough, and which will freely allow flue gases to flow therethrough, in which the conical screen has a lower cylindrical marginal end opposed to an apex thereof; and, further includes a fastener means by which the cylindrical lower marginal end is affixed to the upper marginal end of the stack to extend the cone above the stack, with the apex being axially aligned with the longitudinal axis of the stack.

An additional object of the present invention is the provision of apparatus for preventing birds and other winged creatures from being killed by flue gases emitted by exhaust stacks.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

BRIEF DESCRIPTION OF THE DRAWINGS

FIG. 1 is a part diagrammatical, part schematical representation of the present invention, in combination with a prior art apparatus;

FIG. 2 is an enlarged, fragmentary, perspective view of the present invention, illustrated in combination with a prior device, with some parts broken away therefrom, and some of the remaining parts shown in cross-section;

FIG. 3 is an exploded view of part of the apparatus of FIG. 2;

FIG. 6 is a cross-sectional view taken along line 6—6 of FIG. 3; and

FIG. 7 is a fragmentary representation of an alternate embodiment of the invention, with some parts broken away therefrom, and some of the remaining parts shown in cross section.

DETAILED DESCRIPTION OF THE PREFERRED EMBODIMENT

Figure 4:
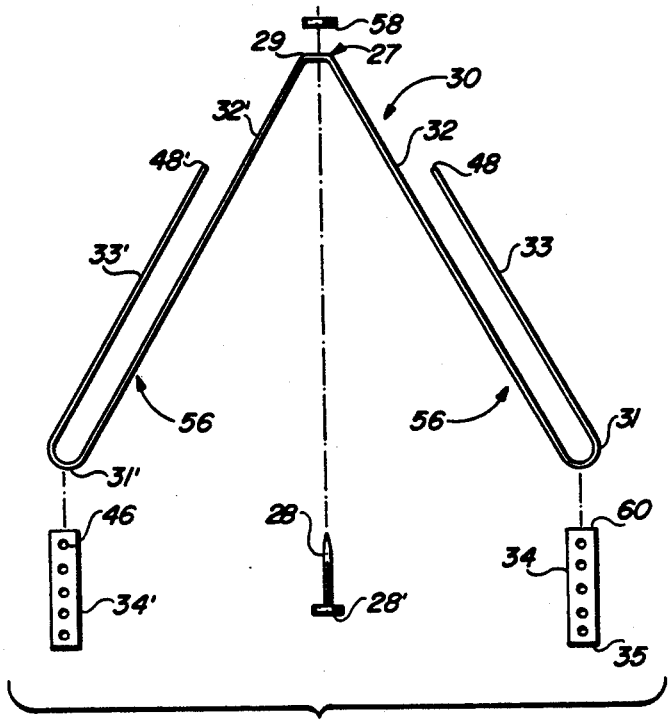
FIG. 4 is a disassembled view of part of the apparatus of FIG. 2.

FIG. 1 of the drawings discloses a bird protector 10 attached to the upper marginal end of a flue gas stack 12 for preventing birds and other flying animals from entering the stack 12. An interior baffle 13 is supported within the combustion chamber of an oil field dehydrator 14. A burner assembly 15 is positioned for combusting hydrocarbons with air to thereby generate heat for heating a mixture of crude oil and water flowing through the dehydrator apparatus.

In FIG. 2, the stack 12 has an outer annular shell 16 spaced therefrom and forming annular area 18 therebetween. A bird protector 10, made in accordance with this invention, is attached about the outer surface of the upper marginal end of the outer shell 16 of stack 12. The protector is in the form of a cone 22 that is made of expanded, perforated metal or open wire mesh. The conical protector can be made of perforated or expanded metal or wire screen. The metal composition can be steel, galvanized wire, aluminum and stainless steel. The openings of the metal screen is 1/16 inch minimum to 1 inch maximum. In the preferred embodiment, the bird protector will have hole openings of ¼ inch diameter, with various center line spacing. It is contemplated that all angular variances on the slope of the cone will be included. The cone surface preferably is seamless.

As best seen in the embodiment of FIG. 3, together with other figures of the drawings, cone 22 has a base 23 and terminates at apex 26. A clamp 24 is positioned about cylindrical bottom part 25 to releasably attach the cone to the upper end of outer shell 16. The cone cylindrical bottom part 25 can also be attached directly to a stack 12 having no outer shell 16 thereon.

Figure 5:
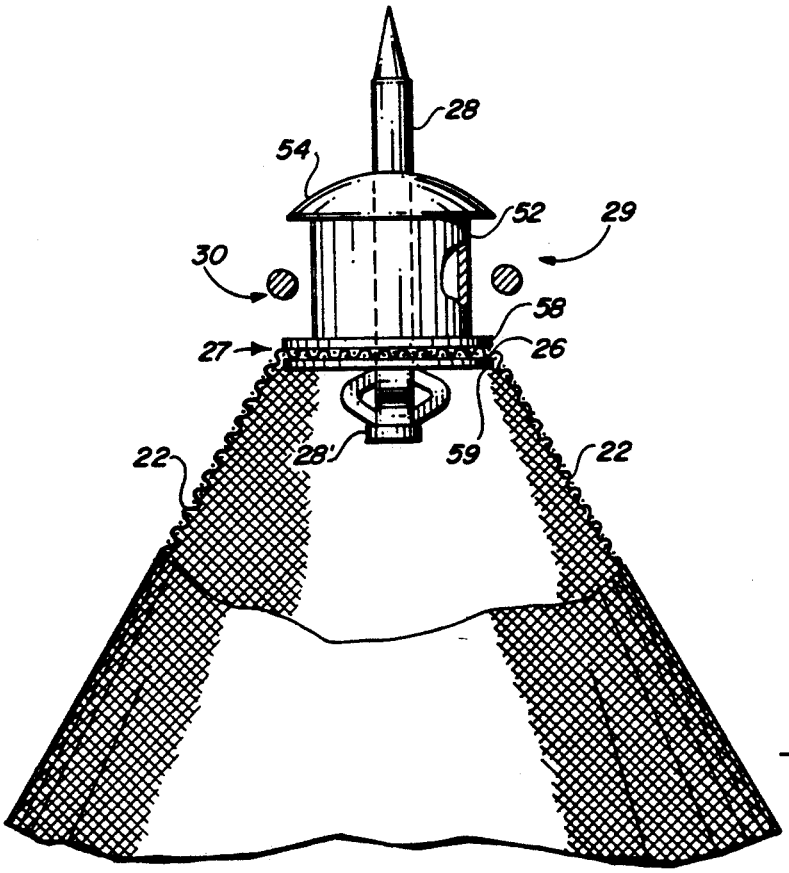
FIG. 5 is a detailed, part cross-sectional representation of part of the apparatus of the previous figures, with some parts broken away therefrom, and some of the remaining parts shown in cross-section.

Another form of the invention includes a sharp pointed fastener means 28 that is attached to and extends from apex 26 and is axially aligned along the vertical central axis of the cone. In FIGS. 2, 4 and 5, the arrow at numeral 27 indicates the apex has been deformed into a truncation for receiving fastener means 28 at apex 26 thereof.

FIGS. 2 and 4 illustrate a balanced twirler or bird repelling member 30 for frightening birds. The repelling member 30 is fabricated of a wire rod and has opposed medial lengths 32, 32' attached to a center attachment part 29. The opposed medial lengths 32, 32' extend parallel to the conical surface in spaced relationship therefrom and receive a reverse bend at 31, 31' that positions the resultant two lengths 32 and 33 parallel with one another. The opposed outermost marginal lengths 33, 33' are shorter respective to the opposed medial lengths 32, 32'. Swing or flutter members 34 have opposed ends 35 and 60, and the body portion is perforated by apertures 46, by which the flutter members are swingingly received by the reverse bend 31, 31'. Numerals 48 and 48' indicate the terminal free end of the opposed marginal length 33 and 33'. The cone surface has a 70 degree included angle which is the optimum angle to discourage birds from perching thereon.

As shown in FIGS. 2 and 3, lower screen assembly 36 likewise is made of mesh having the same specifications recited above. The lower screen assembly is deformed into a conical body portion 38 that is a frustrum of a cone, an upper cylindrical part 37 is joined to the large diameter part of the cone, and an opposed lower cylindrical part 39 is joined to the small diameter part of the cone. Numeral 41 indicates the upper edge and numeral 43 indicates the lower edge of the lower screen assembly 36.

Fastener means 40 is a commercially available metal clamp that affixes the before mentioned upper cylindrical part 37 of the lower screen assembly 36 to the outer shell 16, while fastener means 42 affixes lower cylindrical part 39 of the lower screen assembly 36 to stack 12.

In FIG. 5, an ordinary pop rivet fastener 28' attaches annular spacer 52 between the oval head 54 and a washer 58. In this embodiment of the invention, apex 26 is deformed into a flat by washers 58 and 59 that are fastened on opposed sides thereof by means of the pop rivet. The lower marginal end of the pop rivet is upset as shown to compress the washers and spacer together. The center attachment part 29 of the balanced bird repelling member 30 is wrapped into a tight circle about the spacer 52 so that the opposed ends thereof extend 180 degrees apart from the apex.

In FIG. 4, the arrows at numeral 56 indicate that the opposed members extend outwardly with a 70 degree angle formed therebetween. The upper end 60 of swing or flutter members 34, 34' are swingingly attached by one of the illustrated apertures 46 to the reverse bend 31, 31' of the bird repelling member 30. Numeral 35 indicates the free end of swing or flutter members 34, 34'.

Where deemed desirable, spaced, superimposed, offset baffles 62 and 64, can be supported within cone 22 for reinforcing the outer conical surface of the screen and providing adjustment for flame control. Numeral 66 of FIG. 6 indicates an opening at one end of baffle 64.

In FIG. 7, vent pipe 68 communicates the vapor space of a crude storage tank 70 with ambient. A guard 74, made of the above specified wire mesh, is cylindrical in cross-section and is of a size to be telescoped about the vent 68. The outer end 72 of guard 74 has a closure member formed thereon. Fastener 76 clamps the marginal edge of the cylindrical guard 74 to the outer surface of vent 68. The embodiment disclosed in FIG. 7 will also accommodate highway pipeline crossing vent openings.

In operation, the bird protector 10 prevents birds and other flying animals from entering the flue gas stack 12 and nesting therewithin. Where the stack includes an outer shell 16, the cone 22 is fastened to the upper marginal end of the outer shell, with the apex of the cone coinciding with the longitudinal central axis of the stack 12. It is preferred to include a lower screen 36 in the form of a frustrum of a cone for closure of the lower entrance that leads into annulus 18.

A sharp point 28 upwardly extends from the apex to discourage birds from alighting thereon. A bird repelling member 30 is affixed to the fastener 28 to frighten and thereby discourage birds from attempting to land on any portion of the stack outlet, including the apparatus of this invention. The hanging swing member flutter device 34, 34' moves when disturbed by the elements, and this too serves to frighten and repel birds therefrom.

The bird repelling member 30 preferably is a bent up length of wire having a flat medial attachment part 29 that is received at truncation 27 that forms apex 26.

Fastener 58 engages pointed coacting fastener 28 with sufficient friction to dispose the sharp end 28 in mounted relationship to the apex of the combination.

I claim:

1. A flue gas stack having an outlet end, and a central longitudinal axis, in combination with apparatus to prevent birds from alighting on the outlet end of said flue gas stack, comprising:

a conical wire screen cap of a size to preclude birds traveling therethrough and to freely allow flue gases to flow therethrough, said cap having a lower marginal end opposed to an apex thereabove;

fastener means by which said lower marginal end of said cap is affixed to the marginal outlet end of the stack with said apex being axially aligned with the central longitudinal axis of the stack;

said cap terminates in a sharp point at said apex.

2. The apparatus of claim 1 wherein the stack has an outer shell that forms an annulus at the outlet end thereof, a screen barrier in the form of a frustum of a cone that terminates in a lower small diameter marginal end opposed to an upper large diameter marginal end; means by which the lower small diameter marginal end is attached to the stack and the upper large diameter end thereof is attached to the outer shell.

3. The apparatus of claim 2 and further including a fastener affixed to said apex and extending upwardly therefrom; the terminal end of said fastener being reduced into a sharp point to form a bird repelling member.

4. The apparatus of claim 1 and further including an elongated bird repelling member supported respective to said apex and extending upwardly therefrom; the terminal end of said bird repelling member being reduced to form a sharp point to prevent birds from alighting thereon.

5. The apparatus of claim 4 wherein said bird repelling member includes opposed medial lengths attached to a center attachment part, the opposed medial lengths extend parallel to the conical surface of said cap in spaced relationship therewith and receive a reverse bend that positions the resultant medial length parallel with opposed outermost marginal lengths; the opposed outermost marginal lengths are shorter respective to the opposed medial lengths; a flutter member has a body portion with opposed ends, and the body portion is perforated, by which said flutter member is swingingly received by the reverse bend.

6. The apparatus of claim 1 and further including a bird repelling member attached to said apex; said repelling member includes opposed medial lengths attached to a center attachment part, the opposed medial lengths extend parallel to the conical surface of said cap in spaced relationship therewith and receive a reverse bend that positions the resultant medial lengths parallel with opposed outermost marginal lengths; the opposed outermost marginal lengths are shorter respective to the opposed medial lengths; a flutter member has a body portion with opposed ends, and the body portion is perforated, by which said flutter member is swingingly received by the reverse bend.

7. The apparatus of claim 1 and further including baffle means supported by said stack for adjustment of flow rate through said stack.

8. An apparatus for preventing birds from alighting near the outlet of a flue gas stack, the improvement comprising:

a conical wire screen cap having openings formed therein of a size to preclude birds traveling therethrough and arranged at a slope to prevent birds from perching thereon, and to freely allow flue gases to flow therethrough; said cap having a lower marginal end opposed to an apex thereof; said stack having an upper marginal end and a central longitudinal axis;

fastener means by which said lower marginal end is adapted to be affixed to the upper marginal end of the stack with said apex being axially aligned with the central longitudinal axis of said stack; and, means forming a sharp point at said apex.

9. The apparatus of claim 8 wherein the stack includes an outer shell at the outlet end thereof, a screen barrier in the form of a frustrum of a cone terminates in upper and lower marginal ends; means by which the lower marginal end is adapted to be attached to the stack and the upper marginal end thereof is adapted to be attached to the outer shell.

10. The apparatus of claim 8 and further including a fastener affixed to said apex and extending upwardly therefrom; the terminal end of said fastener being reduced into a sharp point to form a bird repelling member.

11. The apparatus of claim 8 and further including a bird repelling member, said bird repelling member includes opposed medial lengths attached to a center attachment part, the opposed medial lengths extend parallel to the conical surface of said cap in spaced relationship therewith, and receive a reverse bend that positions the resultant medial lengths parallel with opposed outermost marginal lengths; the opposed outermost marginal lengths are shorter respective to the opposed medial lengths;

swing members having opposed ends; the body portion of said swing members having perforations, by which said swing members are swingingly received by said reverse bend.

12. The apparatus of claim 8 wherein the stack includes an outer shell at the outlet end thereof, a screen barrier in the form of a frustrum of a cone terminates in opposed upper and lower marginal ends; means by which the lower marginal end is adapted to be attached to the stack and the upper marginal end thereof is adapted to be attached to the outer shell; and further including a fastener means affixed to said apex and extending upwardly therefrom;

the terminal end of said fastener means being reduced into a sharp point to form a bird repelling member.

13. The improvement of claim 8 and further including baffle means supported at the outlet end of said stack for adjustment of flow rate through said stack.

14. In a flue gas stack having an outlet end for emitting flue gases into the atmosphere, said stack having an outer annular member spaced from the stack and concentrically arranged therewith for flow of gas therebetween, the combination with said stack of a cap apparatus to prevent birds from alighting on stacks; said stack has an upper marginal end and a central longitudinal axis;

said cap apparatus comprising a conical screen of a size to preclude birds traveling therethrough and to freely allow flue gases to flow therethrough, said cap having a lower marginal end opposed to an apex thereof;

fastener means by which said lower marginal end is affixed to the upper marginal end of the stack with said apex being axially aligned with said stack;

means on the exterior of said cap to frighten birds from perching on the cap;

the means on the exterior of said cap includes a member attached to said apex and extending upwards therefrom;

said conical screen forms a sidewall that slopes downwardly and outwardly from the apex thereof.

15. The combination of claim 14 and further including a frustrum of a cone which terminates in opposed upper and lower marginal ends; said lower marginal end of said frustrum of a cone attaches to the stack and said upper marginal end attaches to said outer annular member, said conical sidewall slopes 70 degrees downwardly and outwardly from the apex thereof.

16. The combination of claim 14 wherein the outer annular member includes an outer shell at the outlet end of the stack, a screen barrier in the form of a frustum of a cone terminates in opposed upper and lower marginal ends; means by which the lower marginal end is attached to the stack and the upper marginal end thereof is attached to the outer shell; and the means on the exterior of said cap further including a fastener means affixed to said apex and extending upwardly therefrom;

the terminal end of said fastener means being reduced into a sharp point to form a bird repelling member.

17. The combination of claim 14 and further including baffle means at the outlet end of said stack for adjustment of flow rate through said stack.

* * * * *